US009683746B2

(12) United States Patent
Yun

(10) Patent No.: US 9,683,746 B2
(45) Date of Patent: Jun. 20, 2017

(54) COMBUSTION APPARATUS

(71) Applicant: FLINT Co., Ltd., Ansan-si, Gyeonggi-do (KR)

(72) Inventor: Seong Wan Yun, Goyang-si (KR)

(73) Assignee: FLINT Co., Ltd., Ansan-si, Gyeonggi-do (KR)

( * ) Notice: Subject to any disclaimer, the term of this patent is extended or adjusted under 35 U.S.C. 154(b) by 169 days.

(21) Appl. No.: 14/426,141

(22) PCT Filed: Aug. 26, 2013

(86) PCT No.: PCT/KR2013/007614
§ 371 (c)(1),
(2) Date: Mar. 4, 2015

(87) PCT Pub. No.: WO2014/042363
PCT Pub. Date: Mar. 20, 2014

(65) Prior Publication Data

US 2015/0219341 A1 Aug. 6, 2015

(30) Foreign Application Priority Data

Sep. 12, 2012 (KR) ..... 10-2012-0100813

(51) Int. Cl.
*F23D 11/36* (2006.01)
*F24C 5/12* (2006.01)
(Continued)

(52) U.S. Cl.
CPC ..... *F24C 5/12* (2013.01); *F23D 3/08* (2013.01); *F23D 3/22* (2013.01); *F23D 11/36* (2013.01);
(Continued)

(58) Field of Classification Search
CPC .. F23D 11/40; F23D 3/22; F24C 15/00; F24C 5/12
(Continued)

(56) References Cited

U.S. PATENT DOCUMENTS 508,633 A * 11/1893 Herbert ..... H02K 5/04 310/216.091
4,504,215 A * 3/1985 Akiyama ..... F23D 11/005 431/168
(Continued)

FOREIGN PATENT DOCUMENTS

JP 2684867 B2 12/1997
KR 10-1998-0041778 A 8/1998
(Continued)

*Primary Examiner* — Gregory Huson
*Assistant Examiner* — Nikhil Mashruwala
(74) *Attorney, Agent, or Firm* — Novick, Kim & Lee, PLLC; Jae Youn Kim

(57) ABSTRACT

A combustion apparatus is provided. The combustion apparatus includes a fuel reservoir storing fuel therein, and a main body connected to the fuel reservoir by a flexible tube. The main body receives fuel from the fuel reservoir and combusts the fuel therein. The main body is partitioned into an upper space and a lower space by a partition plate. The main body includes a combustor that is provided in the upper space and combusts fuel supplied from the fuel reservoir, a blower that is provided in the lower space to supply air to the combustor, and a heating unit that is removably coupled to the combustor and completely combusts air incompletely combusted in the combustor. The combustion apparatus completely combusts liquefied animal and vegetable oil, thus reducing a tar generation rate.

10 Claims, 3 Drawing Sheets

(51) Int. Cl.

| | |
|---|---|
| ***F23D 11/40*** | (2006.01) |
| ***F24C 15/00*** | (2006.01) |
| ***F23D 3/22*** | (2006.01) |
| ***F24C 5/18*** | (2006.01) |
| ***F24C 5/04*** | (2006.01) |
| ***F23D 3/08*** | (2006.01) |

(52) U.S. Cl.
CPC ..... *F23D 11/40* (2013.01); *F24C 5/04* (2013.01); *F24C 5/18* (2013.01); *F24C 15/00* (2013.01); *F23G 2209/26* (2013.01); *F23G 2900/70* (2013.01)

(58) Field of Classification Search
USPC ..... 126/39 E, 512; 431/331, 332
See application file for complete search history.

(56) References Cited

U.S. PATENT DOCUMENTS

| | | | | |
|---|---|---|---|---|
| 2012/0060819 | A1* | 3/2012 | Hunt | A47J 36/2477 126/1 R |
| 2014/0113238 | A1* | 4/2014 | Kiarostami | F23D 11/10 431/2 |

FOREIGN PATENT DOCUMENTS

| | | | |
|---|---|---|---|
| KR | 20-0405108 | Y1 | 1/2006 |
| KR | 10-1022110 | B1 | 3/2011 |

* cited by examiner

COMBUSTION APPARATUS

TECHNICAL FIELD

The present invention generally relates to combustion apparatuses. More particularly, the present invention relates to a combustion apparatus that can effectively and efficiently combust fuel oil such as liquefied animal and vegetable oil, which has a comparatively high ignition point and high viscosity, making ignition difficult and increasing a tar generation rate.

BACKGROUND ART

As carbon dioxide emissions have increased due to the use of fossil fuel, global warming has become increasingly more severe. As fossil fuel is gradually being exhausted, interest is increasing in alternative energies to replace fossil fuel.

Furthermore, such an interest in alternative energy has led to the coining of the term "Green Growth".

The term "Green Growth" refers to saving and efficiently using energy and resources to reduce climate change and environmental damage and achieve energy independence. The idea of "Green Growth" also refers to researching and developing clean energy and green technology to resolve the current global economic crisis and create new areas of growth and jobs. The notion of "Green Growth" was first mentioned in <The Economist> on January 2000 and started to be widely used at the Davos Forum (World Economic Forum).

"Seoul Initiative on Green Growth" was adopted in the Ministerial Conference on Environment and Development in Asia and the Pacific 2005 (MECD 2005) and has become a major policy issue in The United Nations Economic and Social Commission for Asia and the Pacific (UNESCAP).

Such policy direction for Green Growth is aimed at green-house gas reduction, reducing use of fossil fuel, strengthening energy independence, strengthening capability to adapt to climate change (adaptation to climate change and energy independence), green technology development, green growth industry, green industry development, upgrading of the industrial structure, creation of a green economic base (new growth power creation), green land and green traffic environment creation, green revolution, and implementing policies so that the Republic of Korea can be a model for global green growth (improvement of the quality of life and enhancing the position of the nation).

As interest in Green Growth increases, there have been efforts to use environment-friendly liquefied animal and vegetable oil in lieu of fossil fuel as a fuel for combustion apparatuses.

Fossil fuel emits carbon dioxide when it burns. Emitted carbon dioxide contributes to global warming. Of course, vegetable oil also emits carbon dioxide when it burns, but plants that become raw material of vegetable oil absorb carbon dioxide from the air while growing. Taking the amount of carbon dioxide emitted when vegetable oil burns and the amount of carbon dioxide absorbed to plants that are used as the raw material of vegetable oil into account, the amount of carbon dioxide emitted from vegetable oil can be substantially zero.

Despite having such advantages, liquefied animal and vegetable oil has not been used as fuel for combustion apparatuses. The reason for this is that generally fuel oil for combustion apparatuses must have suitable ignitability and be low in viscosity, but liquefied animal and vegetable oil has a comparatively high ignition point and has high viscosity, making ignition difficult and increasing a tar generation rate. Due to such characteristics of liquefied animal and vegetable oil, they must be processed to reduce the viscosity to a degree suitable for use as a fuel oil. However, it is expensive to process liquefied animal and vegetable oil. Thus, there is no economic feasibility in the current art.

Consequently, development of a combustion apparatus that can use even liquefied animal and vegetable oil, which has low ignitability and high viscosity, as fuel oil without separate processing, is urgently required.

DISCLOSURE

Technical Problem

Accordingly, the present invention has been made keeping in mind the above problems occurring in the prior art, and an object of the present invention is to provide a combustion apparatus that can easily combust even liquefied animal and vegetable oil, which has low ignitability due to a high ignition point.

Another object of the present invention is to provide a combustion apparatus that realizes complete combustion of liquefied animal and vegetable oil, thus reducing a tar generation rate.

Technical Solution

In order to accomplish the above objects, the present invention provides a combustion apparatus, including: a fuel reservoir storing fuel therein; and a main body connected to the fuel reservoir by a flexible tube, the main body receiving fuel from the fuel reservoir and combusting the fuel therein. The main body is partitioned into an upper space and a lower space by a partition plate and includes: a combustor provided in the upper space, the combustor combusting fuel supplied from the fuel reservoir; a blower provided in the lower space, the blower supplying air to the combustor; and a heating unit removably coupled to an upper part of the combustor, the heating unit completely combusting gas incompletely combusted in the combustor.

The combustor may include: a combustion chamber in which fuel supplied from the fuel reservoir is combusted; and an air supply chamber receiving air from the blower and supplying the air into the combustion chamber. A plurality of air holes may be formed in the combustor between the air supply chamber and the combustion chamber so that air is supplied from the air supply chamber into the combustion chamber through the air holes such that fuel supplied into the combustion chamber is efficiently combusted.

The combustor may include: an inner plate defining the combustion chamber and having a fuel supply hole in a bottom surface thereof, with the air holes formed in a side surface of the inner plate; and an outer plate installed outside the inner plate and spaced apart from the inner plate by a predetermined distance so that the air supply chamber is formed by the inner plate and the outer plate, with an air inlet hole formed in a lower portion of the outer plate so that air supplied from the blower is drawn into the combustor through the air inlet hole.

The air holes may include: a primary-combustion air hole formed in a lower portion of the inner plate, the primary-combustion air hole being used to supply air for primarily combusting fuel in the combustion chamber.

The air holes may further include: a secondary-combustion air hole formed above the primary-combustion air hole, the secondary-combustion air hole being used to supply air for secondarily combusting the primarily-combusted fuel.

The air holes may further include: flame-aligning air holes formed above the secondary-combustion air hole at positions spaced apart from each other at regular intervals in a circumferential direction of the inner plate, the flame-aligning air holes being used to align a flame produced from the combustion chamber with a central portion of the combustor.

The combustion apparatus may further include: a fuel supply pipe made of metal and extending downward from the fuel supply hole, wherein a fuel control device is provided between the fuel supply pipe and the flexible tube, the fuel control device controlling a rate at which fuel is supplied to the combustor.

The blower may include: a blowing fan connected to an output shaft of a motor so as to move air; and a blower duct guiding air blown from the blowing fan to the air inlet hole, wherein a through hole is formed in the blower duct, and the fuel supply pipe passes through the through hole.

A coupling hole may be formed in the partition plate. The coupling hole may have a shape corresponding to a shape of the air inlet hole. The combustion apparatus may further include a clip coupling an edge of the air inlet hole to an edge of the coupling hole so that the combustor is fastened to the partition plate.

Furthermore, a net-shaped support may be provided in the upper space. The net-shaped support may encircle the combustor. A grill may be installed above the net-shaped support, the grill supporting a pot.

The combustion apparatus may further include: a photovoltaic module converting solar energy into electric energy; and a storage battery storing electricity produced from the photovoltaic module and supplying the electricity to the blower.

The heating unit may include: a ceramic member including a stepped portion so that the ceramic member is stably placed on an upper end of the combustor, with an air discharge hole formed in a central portion of the ceramic member such that air combusted in the combustor is discharged through the air discharge hole; and a handle extending from a portion of the ceramic member, the handle enabling a user to grasp the heating unit and place the ceramic member on the combustor or remove the ceramic member therefrom.

The combustion apparatus may further include: a combustion wick disposed in the combustion chamber, the combustion wick absorbing fuel supplied to the combustion chamber and producing a fire; and an extension part extending from the combustion wick upward so that pincers are used to remove the combustion wick out of the combustion chamber.

Advantageous Effects

A combustion apparatus according to the present invention can easily ignite fuel such as liquefied animal and vegetable oil, which has low ignitability due to a high ignition point.

Furthermore, the combustion apparatus makes it possible to completely combust fuel such as liquefied animal and vegetable oil, which is not easily completely combusted, thus reducing a tar generation rate.

BEST MODE

Hereinafter, a combustion apparatus according to an embodiment of the present invention will be described in detail with reference to the attached drawings.

Figure 1:
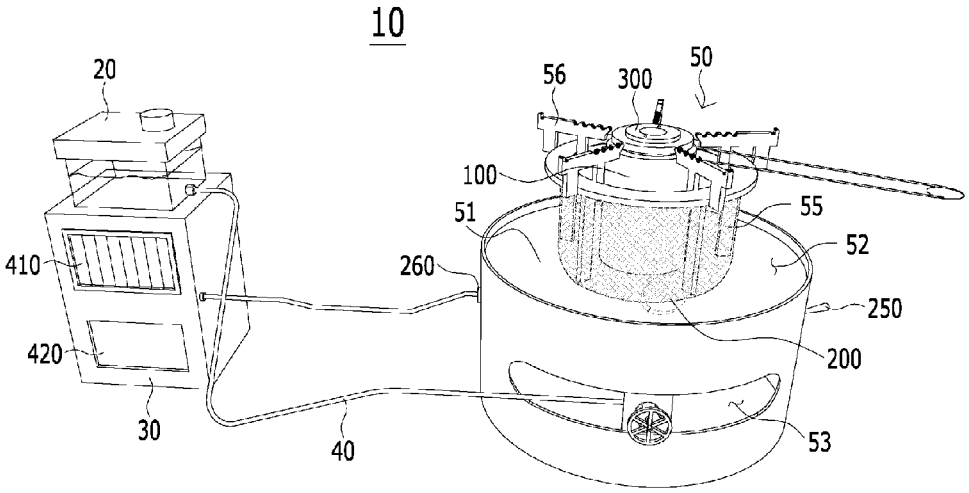
FIG. 1 is a perspective view illustrating a combustion apparatus according to an embodiment of the present invention.

FIG. 1 is a perspective view illustrating a combustion apparatus according to an embodiment of the present invention.

Referring to FIG. 1, the combustion apparatus 10 according to the embodiment of the present invention includes a fuel reservoir 20 that stores fuel therein, and a main body 50 that is connected to the fuel reservoir 20 by a flexible tube 40 so that fuel is supplied into the main body 50 and then combusted therein.

High-viscosity fuel oil such as liquefied animal and vegetable oil (or waste cooking oil) may be used as fuel oil for the combustion apparatus 10 according to the embodiment of the present invention.

The fuel reservoir 20 that stores fuel oil therein is separately provided from the main body 50. The amount of fuel oil such as liquefied animal and vegetable oil that can be stored in the fuel reservoir 20 depends on the capacity of the fuel reservoir 20. Given this, the fuel reservoir 20 preferably has a volume large enough to be filled with a large amount of fuel oil at single time.

The fuel reservoir 20 is connected to the main body 50 by the flexible tube 40 so that fuel oil that is stored in the fuel reservoir 20 can be supplied to the main body 50 through the flexible tube 40. The fuel reservoir 20 is disposed at a position above the main body 50 so that fuel oil that is stored in the fuel reservoir 20 can be naturally supplied to the main body 50 without using a separate supply device.

To dispose the fuel reservoir 20 at a position above the main body 50, the fuel reservoir 20 may be supported on a support 30.

The main body 500 receives fuel oil from the fuel reservoir 20 and combusts it therein. The main body 500 is partitioned into an upper space 52 and a lower space 53 by a partition plate 51.

A combustor 100 that combusts fuel oil supplied from the fuel reservoir 20 is provided in the upper space 52 of the main body 50. A net-shaped support frame 55 encircling the combustor 100, and a grill 56 supporting a pot placed on the support frame 55 are installed in the upper space 52.

Furthermore, a blower 200 supplying air into the combustor 100, a switch 250 turning on or off the blower 200, a power connector 260 to which a power supply for supplying power to the blower 200 is connected, etc. are installed in the lower space 53 of the main body 50.

The structure of the main body 50 will be explained in detail with reference to FIGS. 2 through 4.

Figure 2:
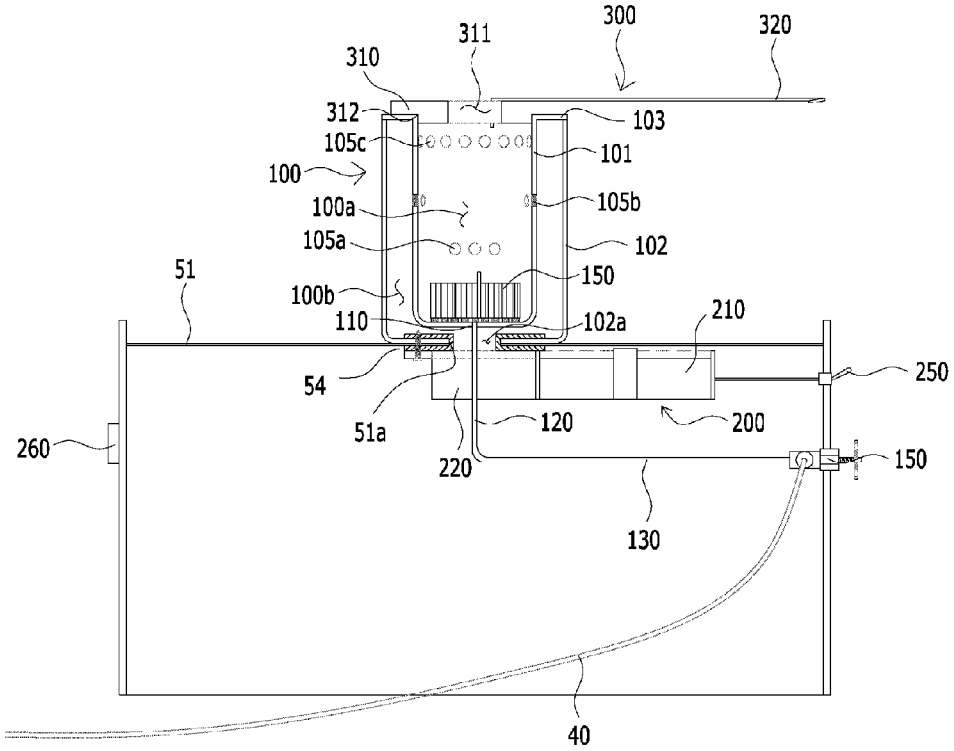
FIG. 2 is a sectional view of a main body of the combustion apparatus of FIG. 1.

FIG. 2 is a sectional view of the main body of the combustion apparatus of FIG. 1. FIG. 3 is an exploded perspective view of the combustor provided in the combustion apparatus of FIG. 1. FIG. 4 is a sectional view of the combustion apparatus of FIG. 1.

Figure 3:
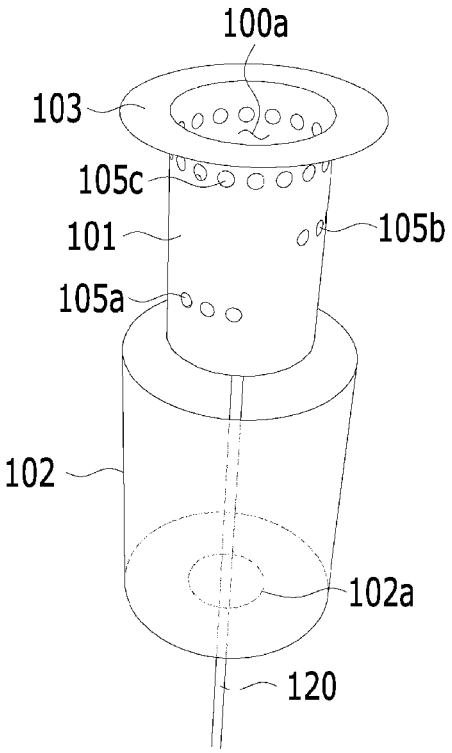
FIG. 3 is an exploded perspective view of a combustor provided in the combustion apparatus of FIG. 1.
Figure 4:
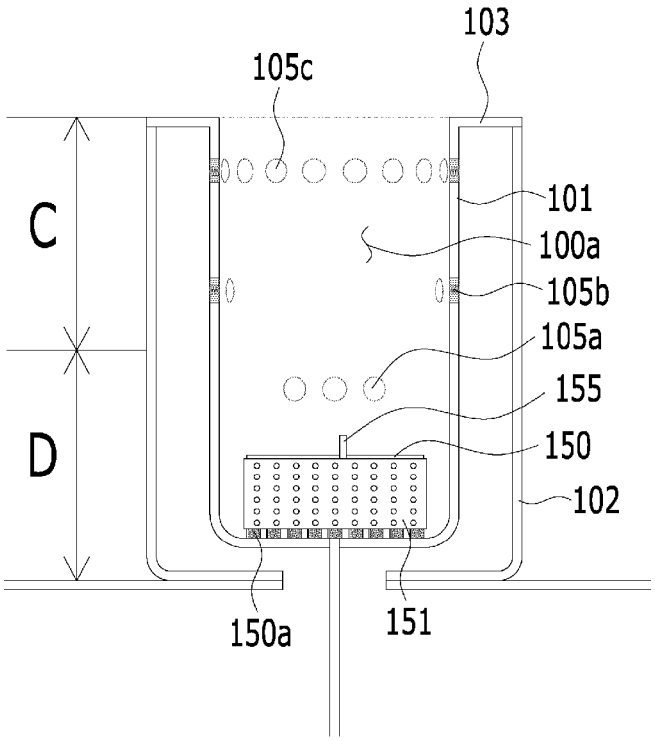
FIG. 4 is a sectional view of the combustion apparatus of FIG. 1.

Referring to FIGS. 2 through 4, the combustor 100 includes an inner plate 101 that defines a combustion chamber 100*a* therein, and an outer plate 102 that forms an air supply chamber 100*b* between it and the inner plate 101.

Furthermore, the combustor 100 further includes an upper plate 103 that is disposed on an upper end of the air supply chamber 100*b* formed between the inner plate 101 and the outer plate 102 so as to connect the inner plate 101 to the outer plate 102.

The combustion chamber 100*a* that receives fuel oil supplied from the fuel reservoir 10 has a cylindrical shape with an open upper end. In this embodiment, although the combustion chamber 100*a* has been illustrated as a cylindrical shape, the combustion chamber 100*a* may have other shapes, for example, a polygonal shape.

Fuel oil such as liquefied animal and vegetable oil is supplied into the combustion chamber 100*a*. Air is supplied into the air supply chamber 100*b* so as to efficiently combust the fuel oil supplied into the combustion chamber 100*a*.

A fuel supply hole 110 for use in supplying fuel oil into the combustion chamber 100*a* is formed in the bottom of the inner plate 101 that defines the combustion chamber 100*a* therein. A fuel supply pipe 120 made of metal extends downward from the fuel supply hole 110. The fuel supply pipe 120 may be integrally formed with the inner plate 101 by welding or the like.

The fuel supply pipe 120 is connected to a metal extension pipe 130 that extends horizontally.

A fuel control device 150 is provided between the fuel supply pipe 120 and the flexible tube 40 so as to control a rate at which fuel oil is supplied from the fuel reservoir 20 to the combustor 100.

As stated above, since the fuel reservoir 20 is disposed at a position above the main body 50, fuel oil that is stored in the fuel reservoir 20 can be naturally supplied to the main body 50 without using a separate supply device. Therefore, a user has only to adjust the fuel control device 150 to control a rate at which fuel oil is supplied from fuel reservoir 20 to the combustor 100.

A lower end of the air supply chamber 100*b* is connected to the blower 200 so that air is supplied from the blower 200 into the air supply chamber 100*b*.

To communicate the air supply chamber 100*b* with the blower 200, an air inlet hole 102*a* is formed in a bottom of the outer plate 102. Furthermore, a coupling hole 51*a* having the same size as that of the air inlet hole 102*a* formed in the outer plate 102 is formed in the partition plate 51 that partitions the main body 50 into the upper space 52 and the lower space 53.

Meanwhile, a clip 54 is used for coupling the edge of the air inlet hole 102*a* to the edge of coupling hole 51*a* so that the combustor 100 can be fastened to the partition plate 51.

As such, because air is introduced into the combustion chamber 100*a*, a combustion wick 150 installed in the combustion chamber 100*a* can rapidly ignite. Moreover, supplying a sufficient amount of air into the combustion chamber 100*a* can prevent incomplete combustion of fuel oil such as liquefied animal and vegetable oil having comparatively high viscosity.

In supplying air from the blower 200 into the combustion chamber 100*a*, air is supplied from the blower 200 into the air supply chamber 100*b* through the air inlet hole 102*a* and then dispersed in the air supply chamber 100*b* before being supplied into the combustion chamber 100*a*.

To enhance efficiency of combustion in the combustion chamber 100*a*, a plurality of air holes 105*a*, 105*b*, and 105*c* is formed in the inner plate 101 such that air supplied into the air supply chamber 100*b* can be dispersed and then uniformly supplied into the combustion chamber 100*a*.

Referring to FIGS. 3 and 4, primary-combustion air holes 105*a* are formed in a lower portion of the outer plate 102 so that air for primarily combusting fuel oil in the combustion chamber 100*a* is supplied into the combustion chamber 100*a* through the primary-combustion air holes 105*a*.

In an embodiment, the primary-combustion air holes 105*a* may be formed below a position corresponding to ½ of the height of the combustion chamber 100*a*. Furthermore, the primary-combustion air holes 105*a* may be spaced apart from the bottom of the combustion chamber 100*a* by a predetermined distance. When air is supplied into the combustion chamber 100*a* through the primary-combustion air holes 105*a*, the air circulates along the inner surface of the combustion chamber 100*a* and can be thus supplied to a portion below the primary-combustion air hole 105*a*. Therefore, air can be supplied to the combustion wick 150 that is disposed in the combustion chamber 100*a*, thus making fuel oil absorbed into the combustion wick 150 be easily ignited. Furthermore, air can be continuously supplied to the ignited combustion wick 150, whereby fuel oil absorbed into the combustion wick 150 can pyrolyze.

Secondary-combustion air holes 105*b* are formed above the primary-combustion air holes 105*a* so that air for use in secondarily combusting the primarily combusted fuel is supplied into the combustion chamber. The secondary-combustion air holes 105*b* may be formed above a position corresponding to ½ of the height of the combustion chamber 100*a*

In addition, the secondary-combustion air holes 105*b* may be disposed at positions opposite to the primary-combustion air holes 105*a* or at both sides of the primary-combustion air holes 105*a*. As such, the reason why the secondary-combustion air holes 105*b* are formed to be misaligned from the primary-combustion air holes 105*a* is to generate eddy currents in the combustion chamber 100*a* and thus uniformly circulate air in the combustion chamber 100*a*.

Due to the above-mentioned structure, a pyrolysis layer D is formed in a lower portion of the combustion chamber 100*a*, and a combustion layer C is formed in an upper portion of the combustion chamber 100*a*.

The pyrolysis layer D is a layer in which fuel oil absorbed into the combustion wick 150 made of ceramic fiber pyrolyzes.

With regard to combustion of fuel oil in the pyrolysis layer D, energy emitted from the ceramic fiber combustion wick 150 heats supplied fuel oil and thus reduces the viscosity of the fuel oil. The fuel oil that is reduced in viscosity is moved to an upper portion of the combustion wick 150 by a capillary phenomenon. As the temperature of the combustion wick 150 increases, fuel oil easily pyrolyzes in the pyrolysis layer D, and fuel oil can be continuously supplied by heat recirculation between the ceramic fiber combustion wick 150 and a combustion flame while air is supplied. In this way, a high-temperature flame can be created.

Fuel oil that has pyrolyzed in the pyrolysis layer is converted into gas by air supplied from the primary-combustion air holes 105*a* and then supplied into the combustion layer C. The combustion layer C is a layer in which high-temperature gas combusts. High-temperature gas supplied from the pyrolysis layer D is mixed with air supplied from the secondary-combustion air holes 105*b* and then combusted. Consequently, even fuel oil such as liquefied animal and vegetable oil having high viscosity can be completely combusted, so that a tar generation rate can be reduced.

Spaced apart from each other at regular intervals in a circumferential direction, flame-aligning air holes 105*c* are formed in an upper portion of an inner circumferential surface of the inner plate 101 that forms the combustor 120. The flame-aligning air holes 105*c* function to bring a flame belched from the combustor 100 into the center.

Because the primary-combustion air holes 105*a* and the secondary-combustion air holes 105*b* are formed in the combustor 100, a flame may be belched from the combustor 100 at predetermined angles of inclination rather than being vertically belched. To prevent a flame from being belched at angles of inclination, air is injected from the flame-aligning air holes 105*c* toward the center of the combustor 100 just before a flame comes out of the combustor 100. Thereby, the flame discharged from the combustor 100 can be aligned with the center axis of the combustor 100.

Meanwhile, the combustion wick absorbing fuel oil is disposed in the combustion chamber 100*a*.

The combustion wick will be explained with reference to FIG. 4. The combustion wick 150 is formed by weaving longitudinal and lateral yarns, made of nonflammable ceramic fibers. The combustion wick 150 includes wick legs 150*a* that are formed in the lower end the combustion wick by the longitudinal yarns from which lateral yarns have been removed to a predetermined height. The reason why the wick legs 150*a* are formed in the combustion wick 150 is because of the fact that, when some of high-temperature gas in the combustion layer C formed in the upper portion of the combustion chamber 100*a* circulates to the lower end of the combustion wick 150, it can reduce the viscosity of fuel oil disposed in the lower end of the combustion wick 150 so that a capillary phenomenon can be reliably secured, whereby fuel oil can be rapidly absorbed into the combustion wick 150.

A perforated wick support frame 151 having a net shape is coupled to the combustion wick 150 so as to support the combustion wick 150. The combustion wick 150 coupled to the wick support frame 151 is twisted in a spiral shape and is removably coupled to the combustion chamber 100*a*. Since the combustion wick 150 is twisted in a spiral shape, spaces are formed in the combustion wick 150. Therefore, pyrolysis of high-temperature gas can be more actively caused in the spaces formed in the combustion wick 150. Furthermore, the combustion wick 150 can be easily replaced with a new one when needed, because the combustion wick 150 is removably coupled to the combustion chamber 100*a*.

Meanwhile, an extension part 155 extends from the combustion wick 150. Thereby, when needed, the combustion wick 150 can be easily removed out of the combustor 100 if the user uses pincers or the like to clamp the extension part 155.

A heating unit 300 for completely combusting gas incompletely combusted in the combustor 100 is provided on the upper end of the combustor 100 and is removably coupled to the combustor 100. Hereinafter, the heating unit will be described in more detail.

Figure 5:
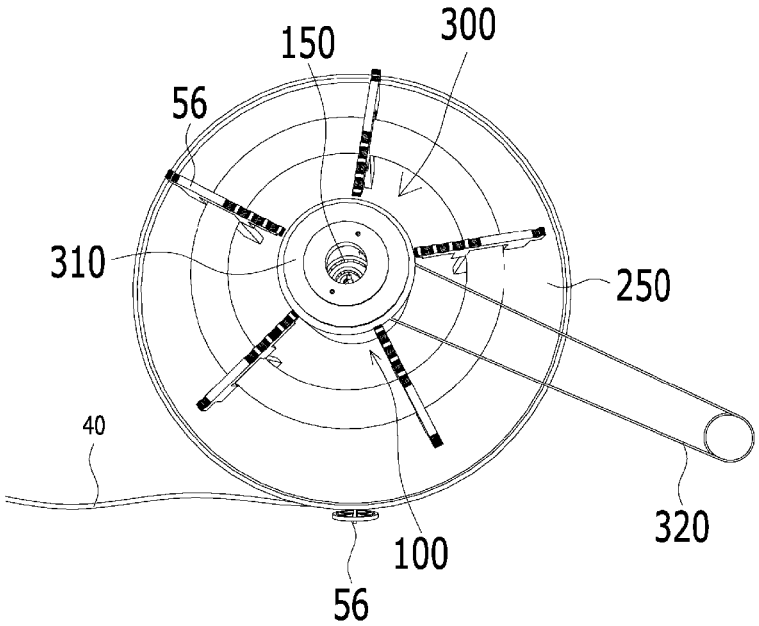
FIG. 5 is a perspective view illustrating a heating unit installed on an upper end of the combustor.

FIG. 5 is a perspective view illustrating the heating unit installed on the upper end of the combustor.

Referring to FIGS. 2 and 5, the heating unit 300 includes a ceramic member 310 that re-heats gas incompletely combusted in the combustor 100 and completely combusts it, and a handle 320 that extends from the ceramic member 310 in a direction to enable the user to grasp the heating unit 300 and remove it from the combustor 100.

The ceramic member 310 has a substantial ring shape with a hollow space 311 in a central portion thereof. A stepped portion 312 is formed in an outer circumferential edge of the ceramic member 310 so that the ceramic member 310 can be stably seated onto the upper end of the combustor 100.

To form the stepped portion 312, the ceramic member 310 is configured such that the outer diameter of an upper part thereof is greater than that of a lower part thereof. Thus, the lower part of the ceramic member 310 is inserted into the combustor 100, while the upper part of the ceramic member 310 is placed on the upper plate 103 of the combustor 100.

The size of the hollow space 311 formed in the ceramic member 310 is much smaller than that of the opening formed in the upper end of the combustor 100. Therefore, most gas that is discharged from the combustor 100 comes into contact with the ceramic member 310 before coming out of the combustor 100 through the hollow space 311 of the ceramic member 310.

The ceramic member 310 is placed on the upper end of the combustor 100 and is in a heated state. Therefore, gas discharged from the combustor 100 is re-heated by energy emitted from the ceramic member 310 so that gas incompletely combusted in the combustor 100 can be completely combusted. Thus, even when liquefied animal and vegetable oil is used as fuel oil for the combustion apparatus, it can be completely combusted, thereby reducing the amount of tar, which is generated in incomplete combustion.

In this embodiment, although the heating unit has been illustrated as being separately installed from the wick, the heating unit may be integrally provided with the wick.

Meanwhile, the blower 200 for supplying air into the combustor 100 is installed in the lower space 53 of the main body 50. Hereinafter, the blower for supplying air into the combustor will be explained in detail.

Figure 6:
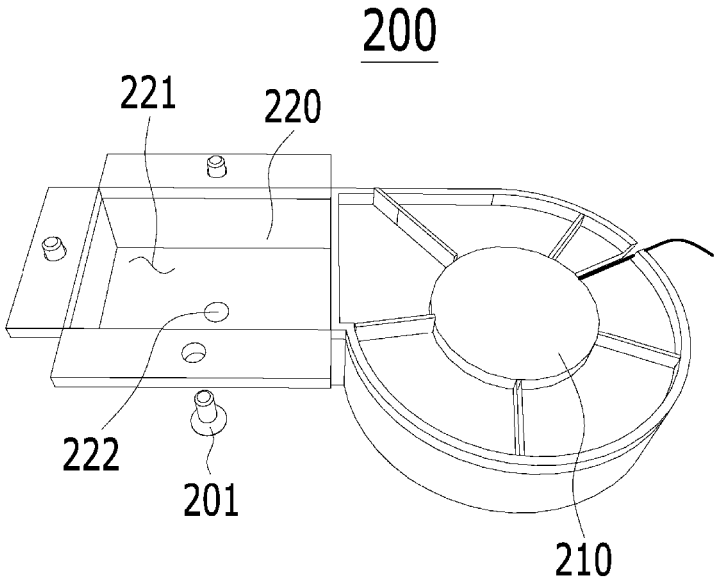
FIG. 6 is a perspective view of a blower provided in the main body of FIG. 1.

FIG. 6 is a perspective view of the blower provided in the main body of FIG. 1.

Referring to FIGS. 2 and 6, the blower 200 includes a blowing fan 210 that is connected to the output shaft of a motor so as to move air, and a blower duct 220 that guides air blown from the blowing fan 210 to the air inlet hole 102*a*.

The blower 200 is coupled to a lower surface of the partition plate 51 by a fastening member 201 such as a screw or the like.

An air discharge hole 221 having a shape corresponding to that of the air inlet hole 102*a* formed in the lower end of the combustor 100 is formed in an end of the blower duct 220. Furthermore, a through hole 222 through which the fuel supply pipe 120 passes is formed in the bottom of a portion of the blower duct 220 in which the air discharge hole 221 is formed.

Therefore, air can be supplied into the air supply chamber 100*b* through the air inlet hole, while fuel can be supplied into the combustion chamber 100*a* through the fuel supply pipe 120.

Meanwhile, electricity is required to operate the blower 200. Of course, in areas where commercial electricity is supplied, the blower 200 can be easily used by connecting power to the power connector 260.

However, as shown in FIG. 1, the combustion apparatus 10 according to the embodiment of the present invention may further include a photovoltaic module 410 and a storage battery 420 so as to make it possible for the combustion apparatus 10 to be used even in remote areas where there is no supply of electricity. In detail, the photovoltaic module 410 converts solar energy into electric energy. The storage battery 420 stores electricity produced from the photovoltaic module 410 and supplies it to the blower 200. Electric wires are used to connect the storage battery 420 to the power connector 260 such that electricity can be supplied to the blower 200.

The photovoltaic module 410 may be disposed outside the support 30 that supports the fuel reservoir 20. The storage battery 420 may be installed in the support 30. In this case, because the storage battery 420, which is comparatively heavy, is installed in the support 30, the fuel reservoir 20 can be more stably supported on the support 30.

As described above, in a combustion apparatus according to an embodiment of the present invention, even liquefied animal and vegetable oil, which is low in ignitability, can be easily ignited. Furthermore, liquefied animal and vegetable oil can be completely combusted, whereby a tar generation rate can be markedly reduced.

Although an embodiment of the combustion apparatus according to the present invention has been disclosed for illustrative purposes, those skilled in the art will appreciate that various modifications, additions and substitutions are possible, without departing from the scope and spirit of the invention as disclosed in the accompanying claims.

The invention claimed is:

1. A combustion apparatus, comprising:

a fuel reservoir storing fuel therein; and a main body connected to the fuel reservoir by a flexible tube, the main body receiving fuel from the fuel reservoir and combusting the fuel therein, wherein the main body is partitioned into an upper space and a lower space by a partition plate and comprises:

a combustor provided in the upper space, the combustor combusting fuel supplied from the fuel reservoir;

a blower provided in the lower space, the blower supplying air to the combustor; and a heating unit removably coupled to an upper part of the combustor, the heating unit completely combusting gas incompletely combusted in the combustor, wherein the combustor comprises:

a combustion chamber in which fuel supplied from the fuel reservoir is combusted;

an air supply chamber receiving air from the blower and supplying the air into the combustion chamber, wherein a plurality of air holes are formed in the combustor between the air supply chamber and the combustion chamber so that air is supplied from the air supply chamber into the combustion chamber through the air holes such that fuel supplied into the combustion chamber is efficiently combusted;

an inner plate defining the combustion chamber and having a fuel supply hole in a bottom surface thereof, with the air holes formed in a side surface of the inner plate; and an outer plate installed outside the inner plate and spaced apart from the inner plate by a predetermined distance so that the air supply chamber is formed by the inner plate and the outer plate, with an air inlet hole formed in a lower portion of the outer plate so that air supplied from the blower is drawn into the combustor through the air inlet hole, and wherein a coupling hole is formed in the partition plate, the coupling hole having a shape corresponding to a shape of the air inlet hole, the combustion apparatus further comprising: a clip coupling an edge of the air inlet hole to an edge of the coupling hole so that the combustor is fastened to the partition plate.

2. The combustion apparatus of claim 1, wherein the air holes comprise:

a primary-combustion air hole formed in a lower portion of the inner plate, the primary-combustion air hole being used to supply air for primarily combusting fuel in the combustion chamber.

3. The combustion apparatus of claim 2, wherein the air holes further comprise:

a secondary-combustion air hole formed above the primary-combustion air hole, the secondary-combustion air hole being used to supply air for secondarily combusting the primarily-combusted fuel.

4. The combustion apparatus of claim 3, wherein the air holes further comprise:

flame-aligning air holes formed above the secondary-combustion air hole at positions spaced apart from each other at regular intervals in a circumferential direction of the inner plate, the flame-aligning air holes being used to align a flame produced from the combustion chamber with a central portion of the combustor.

5. The combustion apparatus of claim 1, further comprising:

a fuel supply pipe made of metal and extending downward from the fuel supply hole, wherein a fuel control device is provided between the fuel supply pipe and the flexible tube, the fuel control device controlling a rate at which fuel is supplied to the combustor.

6. The combustion apparatus of claim 5, wherein the blower comprises:

a blowing fan connected to an output shaft of a motor so as to blow air; and a blower duct guiding air blown from the blowing fan to the air inlet hole, wherein a through hole is formed in the blower duct, and the fuel supply pipe passes through the through hole.

7. The combustion apparatus of claim 1, wherein a net-shaped support is provided in the upper space, the net-shaped support encircling the combustor, and a grill is installed above the net-shaped support, the grill supporting a pot.

8. The combustion apparatus of claim 1, further comprising:

a photovoltaic module converting solar energy into electric energy; and a storage battery storing electricity produced from the photovoltaic module and supplying the electricity to the blower.

9. The combustion apparatus of claim 1, wherein the heating unit comprises:

a ceramic member including a stepped portion so that the ceramic member is stably placed on an upper end of the combustor, with an air discharge hole formed in a central portion of the ceramic member such that air combusted in the combustor is discharged through the air discharge hole; and a handle extending from a portion of the ceramic member, the handle enabling a user to grasp the heating unit and place the ceramic member on the combustor or remove the ceramic member therefrom.

10. The combustion apparatus of claim 1, further comprising:

a combustion wick disposed in the combustion chamber, the combustion wick absorbing fuel supplied to the combustion chamber and producing a fire; and an extension part extending from the combustion wick upward so that pincers are used to remove the combustion wick out of the combustion chamber.

* * * * *